US005308278A

United States Patent [19]

Huang

[11] Patent Number: 5,308,278

[45] Date of Patent: May 3, 1994

[54] FLEXIBLE STRING-LIKE BRASSIERE RETAINER

[76] Inventor: Lindy W. Huang, 3332 Manor Ridge Dr., Raleigh, N.C. 27603

[21] Appl. No.: 979,645

[22] Filed: Nov. 20, 1992

[51] Int. Cl.[5] ..... A41F 15/02

[52] U.S. Cl. ..... 450/86; 2/101; 2/268; 24/306

[58] Field of Search ..... 2/101, 267, 268, DIG. 6, 2/DIG. 7, 73, 338; 450/86, 89; 24/306, 165, 517, 518, 662

[56] References Cited

U.S. PATENT DOCUMENTS

| | | | |
|---|---|---|---|
| 2,497,992 | 2/1950 | Jacques | 2/268 |
| 2,534,513 | 12/1950 | Gerry | 2/268 |
| 2,719,303 | 10/1955 | Lodenius | 2/105 |
| 4,975,987 | 12/1990 | Teachout et al. | 2/244 X |

OTHER PUBLICATIONS

Gershman, Maurice "Self Adhering Nylon Tapes": The JAMA, vol. 168, No. 7, Oct. 1958.

*Primary Examiner*—Clifford D. Crowder
*Assistant Examiner*—Jeanette E. Chapman
*Attorney, Agent, or Firm*—Rhodes, Coats & Bennett

[57] ABSTRACT

The present invention relates to a bra strap retainer that is in the form of an elongated flexible string-like retainer that is adapted to be attached to the shoulder portion of an upper garment or to an upper garment accessory such as a shoulder pad. In a fully attached mode the string-like brassiere strap retainer forms a closed loop and the brassiere strap is threaded through the formed loop and is securely confined within that loop assuring that the bra strap does not fall down the sleeve of the subject wearing the same.

4 Claims, 2 Drawing Sheets

FLEXIBLE STRING-LIKE BRASSIERE RETAINER

FIELD OF THE INVENTION

The present invention relates to apparel and accessories for apparel and more particularly to an attachable and detachable flexible string-like bra strap retainer for confining the bra strap of a brassiere about the upper shoulder area of a person wearing the same.

BACKGROUND OF THE INVENTION

It is not uncommon for a brassiere strap to slide down the shoulder and arm of a women wearing the same. Often this happens while the women is wearing a short sleeve blouse or upper garment and consequently the bra strap is left exposed dangling down around the upper arm area just above the elbow. This is indeed unsightly and even embarrassing.

It is known, however, to provide a structure about the shoulder area of an upper garment for retaining bra straps. For example, see the disclosures in U.S. Pat. Nos. 4,953,233; 5,060,348; 2,719,303; 2,121,513; 1,632,424; 1,797,200; 1,942,734; 1,741,628; and 1,492,361.

Although there have been attempts to provide an efficient, practical and effective brassiere strap retainer, such as those disclosed in the above patents, to a great extent these past designs are not totally satisfactory and have many disadvantages and drawbacks. For example, the bra strap retainers of the prior art have little, if any, flexibility. Such bra straps are closely constructed to the upper garment and the bra strap is effectively fixed or closely confined to the upper garment and there is very little room for the bra strap to move back and forth on the shoulder. This can obviously lead to a very confining and uncomfortable situation.

Beyond that, many brassiere strap retainers of the prior art are hard to use and difficult to manipulate. In this regard, it is found that many such brassiere strap retainers are hard to open and close and it is difficult to effectively thread or confine the brassiere strap within the bra strap retainer.

In addition, the bra strap retainers known tend to have little or no versatility. As pointed out above they are generally fixed to an upper garment and consequently remain attached to that upper garment at all times and cannot be used unless the person is wearing that particular upper garment. Finally, bra strap retainers of the prior art are expensive and difficult to manufacture.

Therefore, there is a need for a new bra strap retainer design that overcomes the drawbacks and disadvantages referred to above that is found in bra strap retainers of the prior art.

SUMMARY AND OBJECTS OF THE INVENTION

The present invention presents a bra strap retainer design that is aimed at overcoming the drawbacks and disadvantages of bra strap retainers of the prior art. In the case of the bra strap retainer of the present invention, the same is designed such that it can be attached and detached from an upper garment directly or to an upper garment accessory such as a shoulder pad. The same bra strap retainer can be attached to one garment or one garment accessory and used and thereafter be removed and reattached to a different upper garment or garment accessory.

In particular, the brassiere strap retainer of the present invention entails a flexible string-like retainer that includes opposite ends that are provided with cooperating attaching means. One end of the string-like retainer is provided with attaching means that attaches the string-like retainer to the garment or garment accessory (e.g. shoulder pad). The other end of the string-like retainer is provided with attaching means that permits the second end to be attached to the first end so as to form a loop-type retainer. Thereafter, the brassiere strap can be threaded through the string-like retainer and confined about the shoulder portion of the woman wearing the same.

It is therefore an object of the present invention to provide a brassiere strap retainer that overcomes the disadvantages, shortcomings and drawbacks of all brassiere strap retainers of the prior art.

A further object of the present invention resides in the provision of a bra strap retainer in the form of a flexible string-like retainer that is capable of a wide range of movement.

Still a further object of the present invention is to provide a bra strap retainer of the character referred to above that is detachably mounted or secured to an upper garment or an upper garment accessory and which can be detached and used on many different upper garments or upper garment accessories.

Another object of the present invention resides in the provision of a brassiere strap retainer of the design and character referred to above that lends itself to being designed and made in a delicate fashion.

Another object of the present invention resides in the provision of a bra strap retainer of the character referred to above that is designed such that its presence underneath the upper garment is inconspicuous and cannot be seen.

Another object of the present invention resides in the provision of a bra strap retainer of the character referred to above that is easy to use and manipulate and wherein its design makes it easy and convenient to secure the brassiere strap within the retainer.

Another object of the present invention resides in the provision of a bra strap retainer that is easy to manufacture and which is relatively inexpensive.

Other objects and advantages of the present application will become apparent and obvious from a study of the following description and the accompanying drawings which are merely illustrative of such invention.

BRIEF DESCRIPTION OF THE DRAWINGS

FIG. 4 is a side view illustrating an unsecured brassiere strap retainer positioned adjacent to a section of the shoulder pad.

DETAILED DESCRIPTION OF THE INVENTION

Figure 1:
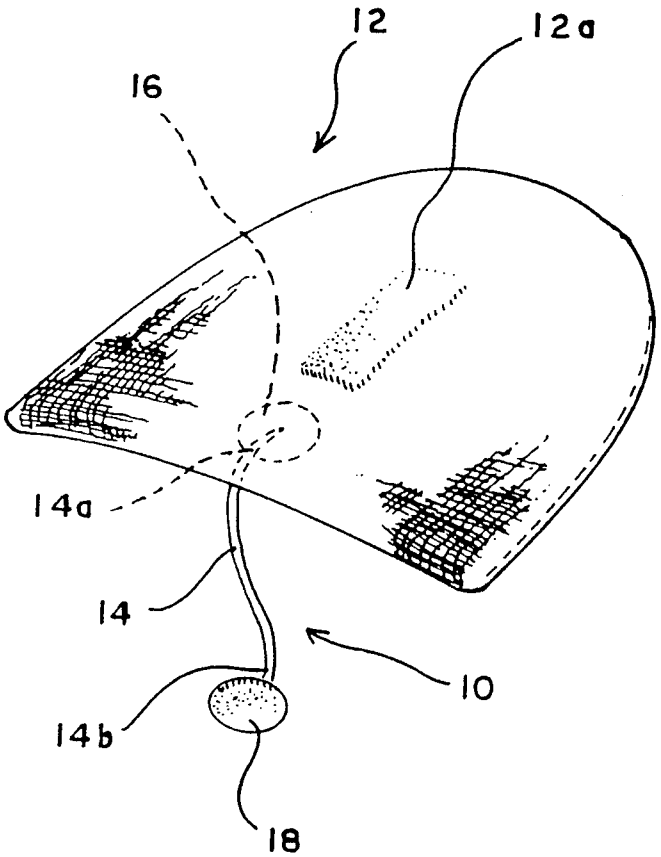
FIG. 1 is a perspective view of the brassiere strap retainer of the present invention secured at one end to the underside of a shoulder pad and hanging therefrom.

With further reference to the drawings the bra strap retainer of the present invention is shown therein and indicated generally by the numeral 10. In the present disclosure bra strap retainer 10 is shown and used in conjunction with a shoulder pad, indicated generally by the numeral 12. The shoulder pad 12 is of the type that is provided with a Velcro® attaching strip 12*a* that enables the same to be attached to a mating Velcro® strip on the underside of the shoulder portion of an upper garment. It should, however, be appreciated that the bra strap retainer 10 of the present invention can be used directly with the upper garment itself as the same can be attached and detached to the upper garment itself.

Turning now to the bra strap retainer 10 it is seen that the same includes a flexible string-like retainer 14 that includes a first end 14*a* and a second end 14*b*. Secured to end 14*a* is a first Velcro® fastener 16. Velcro® fastener 16 in this embodiment illustrated includes Velcro® fastening elements on both sides thereof. In particular, on one side of the first Velcro® fastener 16 there is provided Velcro® fastening elements that are designed to mate and connect with cooperating Velcro® fastening means formed on the underside of the shoulder pad 12. Therefore, it is appreciated that the entire bra strap retainer 10 can be easily attached and detached to the shoulder pad 12. On the opposite side or the exposed side of the first Velcro® fastener 16 the same is provided with additional Velcro® fastening elements. As will be appreciated from subsequent portions of this disclosure the Velcro® fastening elements on the exposed side of the fastener 16 will enable the entire flexible member 16 to be looped back and connected at the point where the first Velcro® fastener 16 fastens to the shoulder pad 12.

Figure 2:
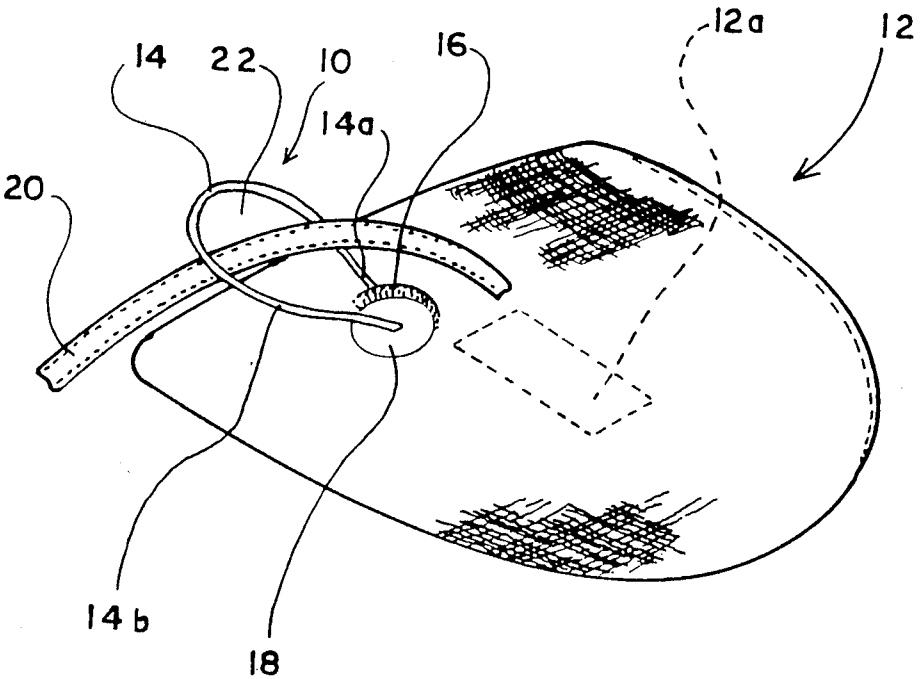
FIG. 2 is a perspective view of the same brassiere strap retainer with the opposed ends secured together to form a loop for receiving and retaining the brassiere strap.
Figure 3:
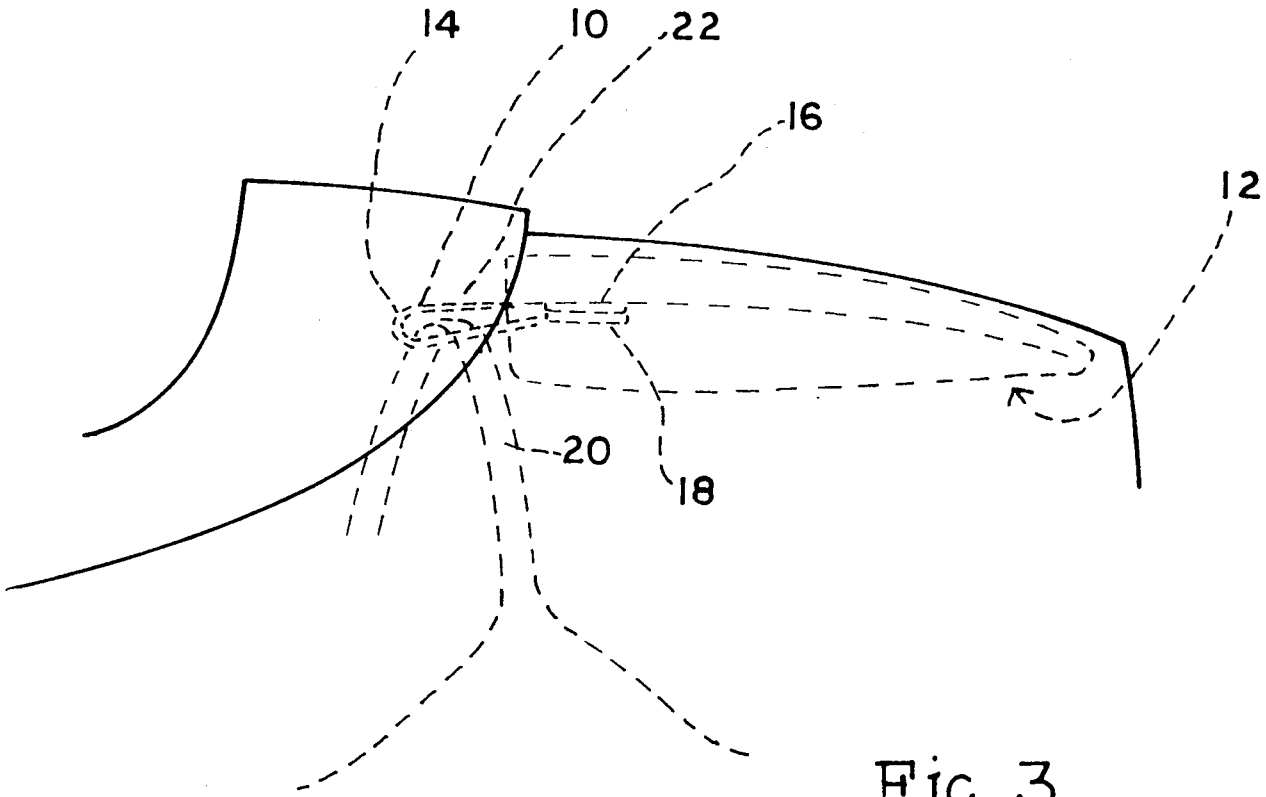
FIG. 3 is a fragmentary side elevational view illustrating the brassiere strap retainer confined around a brassiere strap.

Secured to the opposite end 14*b* of the flexible retainer 14 is a second Velcro® fastener 18. About the outer exposed side of Velcro® fastener 18 there is provided Velcro® fastening elements that are adapted to attach to the exposed side of the first Velcro® fastener 16 to form a loop 22 as shown in FIG. 2. It is therefore appreciated that when the loop has been completed as shown in FIGS. 2 and 3, that the bra strap 20 extends through the formed loop 22 and is retained therein.

As seen in FIG. 1, when one end of the flexible retainer 14 is secured to the shoulder pad 12, the entire string-like flexible retainer 14 can be freely moved, rotated and swung around its point of connection with the shoulder pad 12. This makes the bra strap retainer 10 of the present invention very flexible, easy to manipulate, and easy to fasten around the bra strap 20.

In the above disclosure, the present invention has disclosed the fastening means in the form of Velcro® fasteners. It will be appreciated that standard and conventional snap fasteners can be used in conjunction with the present invention. Also, the present disclosure shows the present invention incorporated into a shoulder pad. It should be appreciated that the present invention can be secured directly to the shoulder portion of an upper garment. In other words, the shoulder pad itself is not necessary.

Also, it should be pointed out that in a preferred design the brassiere strap retainer of the present invention would be secured approximately one inch from the neck of the subject utilizing the present invention. It will also be appreciated that the brassiere strap retainer should be designed such that when secured and formed into a loop, the loop will be sufficiently short such that it will remain hidden under the upper garment and not be exposed.

From the forgoing discussion it is appreciated that the bra strap retainer 10 of the present invention has many advantages over bra strap retainers of the prior art and presents an economical and simple design that has many advantages over bra straps of the prior art.

The present invention, may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A brassiere strap retainer connected to a garment for confining a brassiere strap about the shoulder of a woman comprising:

a) an elongated flexible string retainer having first and second opposite ends;

b) a pair of mating fasteners attached to opposite ends of the string retainer, the retainer secured to the garment by only one of said fasteners, wherein the retainer has an unconnected mode wherein the pair of fasteners are not attached to each other and the retainer hangs freely from the secured fastener, and wherein the retainer has a connected mode wherein the pair of fasteners are attached to each other and the string retainer forms an enclosed loop that defines a brassiere strap opening and that can be moved, rotated and swung with respect to it point of connection with the garment; and c) wherein when the pair of mating fasteners are connected to give rise to the connected mode the string retainer is adapted to receive a brassiere strap through the brassiere strap opening and to loosely confine the brassiere strap underneath the garment such that the brassiere strap is completely flexible and can be moved, rotated and swung with respect to its point of connection with the garment.

2. The brassiere strap retainer of claim 1 wherein the pair of mating fasteners includes cooperating hook and loop fasteners.

3. The brassiere strap retainer of claim 1 wherein said secured fastener is designed such that the same is detachably secured to the garment such that the bra strap retainer can be detached therefrom and used on another garment.

4. The brassiere strap retainer of claim 1 wherein said secured fastener includes a connecting pad and wherein the connecting pad includes VELCRO® connecting elements on each side thereof and wherein one side of the connecting pad is adapted to secure to the garment while the other side of the connecting pad being adapted to connect to the other said fastener so as to position the retainer in the connected mode.

* * * * *